US006625906B2

(12) United States Patent
Mayer et al.

(10) Patent No.: US 6,625,906 B2
(45) Date of Patent: Sep. 30, 2003

(54) INSOLE AND USE OF THE SAME FOR PRODUCING A SHOE

(76) Inventors: Helmut Mayer, Schönbühl 10, 73342 Bad Ditzenbach (DE); Gerd Mayer, Schönbühl 10, 73342 Bad Ditzenbach (DE); Achim Mayer, Schönbühl 10, 73342 Bad Ditzenbach (DE)

( * ) Notice: Subject to any disclaimer, the term of this patent is extended or adjusted under 35 U.S.C. 154(b) by 0 days.

(21) Appl. No.: 09/980,069

(22) PCT Filed: Mar. 9, 2001

(86) PCT No.: PCT/EP01/02715

§ 371 (c)(1),
(2), (4) Date: Nov. 28, 2001

(87) PCT Pub. No.: WO01/72172

PCT Pub. Date: Oct. 4, 2001

(65) Prior Publication Data

US 2002/0162246 A1 Nov. 7, 2002

(30) Foreign Application Priority Data

Mar. 28, 2000 (DE) ..... 100 15 240

(51) Int. Cl.[7] ..... A43B 13/38; A43B 7/14; A43B 17/00

(52) U.S. Cl. ..... 36/30 R; 36/30 A; 36/28

(58) Field of Search ..... 36/30 R, 44, 30 A, 36/31, 28, 25 R, 32 R, 102, 22 R

(56) References Cited

U.S. PATENT DOCUMENTS

| | | | | |
|---|---|---|---|---|
| 5,784,808 A | * | 7/1998 | Hockerson | 36/30 R |
| 5,983,524 A | * | 11/1999 | Polegato | 36/30 R |
| 6,158,149 A | * | 12/2000 | Rudy | 36/28 |
| 6,219,942 B1 | * | 4/2001 | Fini | 36/25 R |
| 6,367,172 B2 | * | 4/2002 | Hernandez | 36/30 R |

FOREIGN PATENT DOCUMENTS

WO WO 9112740 A1 * 9/1991 ..... A43B/07/28

* cited by examiner

*Primary Examiner*—Anthony D. Stashick
(74) *Attorney, Agent, or Firm*—Grant D. Kang; Husch & Eppenberger LLC

(57) ABSTRACT

An insole suitable for adaptation of a shoe to the particular foot width of the wearer includes a support sole (2) with a lateral delimitation (3) corresponding to the actual insole outline; a dish-shaped edge (4) extending upwardly and laterally beyond the support sole delimitation (3), connected firmly to the support sole, and manufactured from a softer and more flexible material than the support sole material; a thickening (5) on the front side of the support sole (2) with a lateral delimitation (6) that is displaced in an inward direction relative to the support sole delimitation (3), forming a lasting margin recess (7) on the underside of the insole; and a sock selected from a set of socks, each sock in the set having an identical heel thickness and a front foot thickness that is graduated among each sock in the set to correspond to different foot widths.

15 Claims, 3 Drawing Sheets

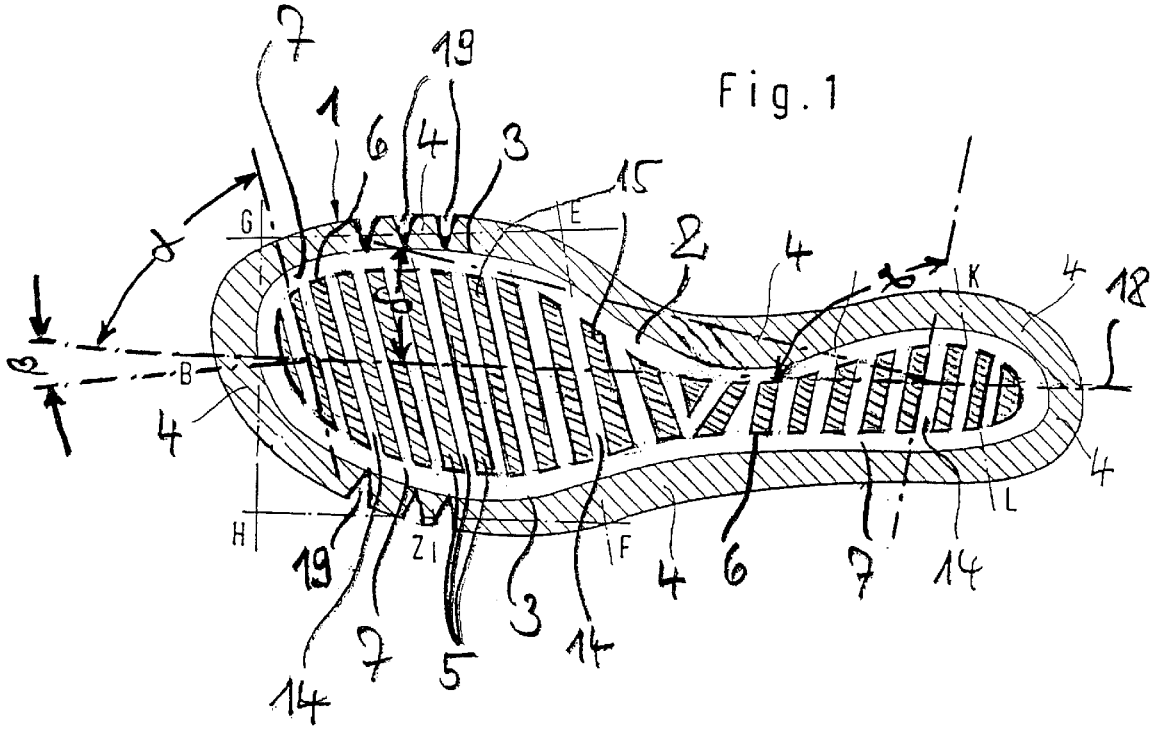
Fig. 1
Fig. 2
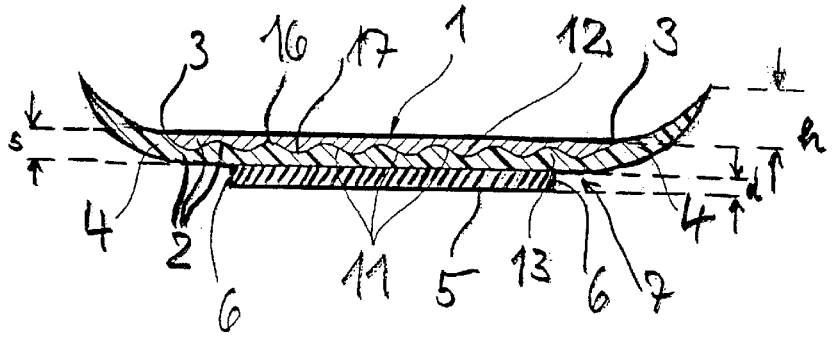

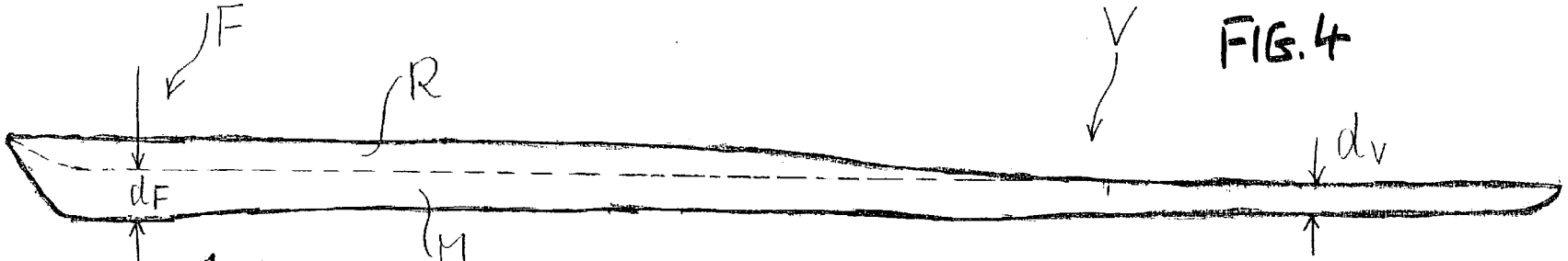
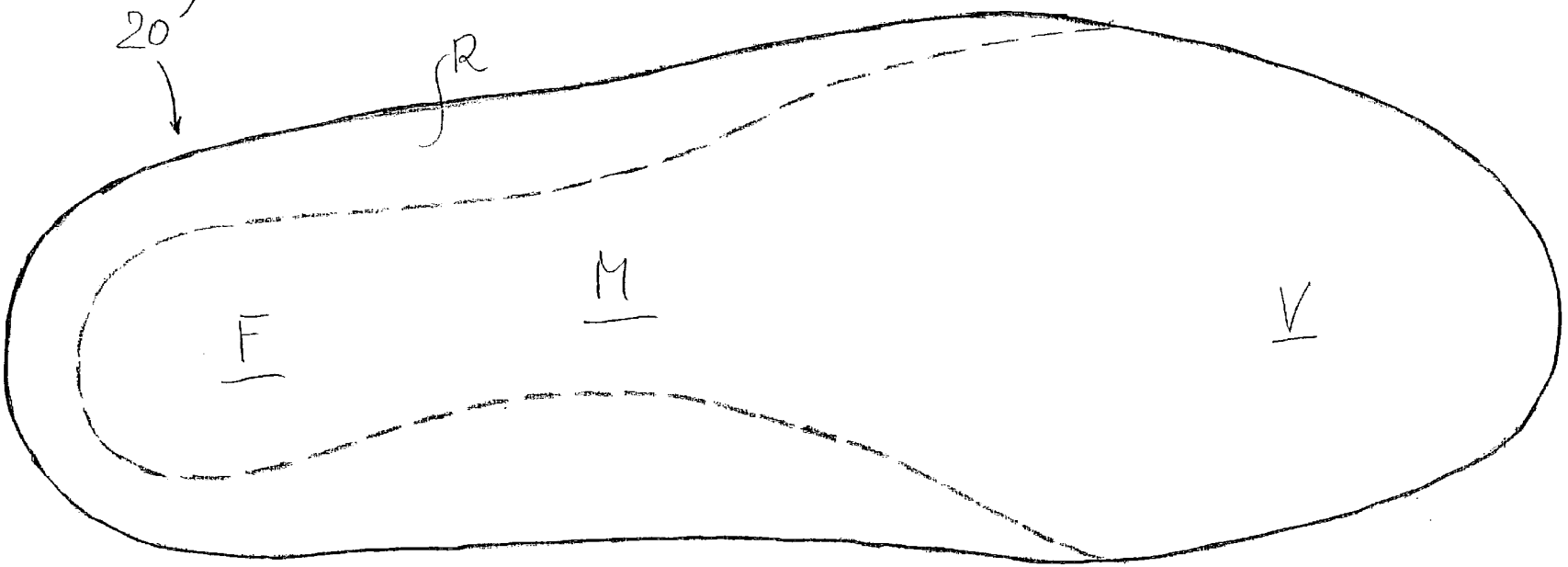
FIG. 5

INSOLE AND USE OF THE SAME FOR PRODUCING A SHOE

The invention relates to an insole and the use thereof for manufacturing a shoe which can be used in conjunction with one or more socks for adaptation of the shoe to the particular foot width of the wearer, so that one and the same shoe can be adapted, according to the thickness of the sock, to different foot widths in a virtually ideal fit.

Such adaptation is of great advantage in particular in children's shoes because, as far as children's shoes are concerned, a tendency exists to make use of a "standard shoe" on account of the relatively much smaller market in comparison with adults, that is to say shoes which are available in only a single (medium) foot width in each size, and because on the other hand it is especially important in the case of children, in view of the fact that their feet are still developing, to have shoes available which are adapted to the particular foot width in order that healthy foot development is ensured.

The insole according to the invention is moreover suitable in the same way for adults' shoes and indeed for walking shoes, work shoes, sport shoes and all other types of shoe, and it makes possible in this context also adaptation of one and the same shoe to different foot widths, it being possible for the outer appearance of the shoe as such to be of very elegant design in contrast to previous orthopedic shoes, because the insole according to the invention makes it possible to position the foot unusually deeply inside the shoe and to provide thin outsoles.

The object of the present invention is in particular to make available an insole which makes it possible to manufacture shoes which, with outstanding transverse stability and excellent longitudinal flexibility of the sole on the one hand and with cost-effective, efficient and relatively uncomplicated manufacturability on the other hand, can be adapted to different foot widths, without the elegance of the shoe shape being impaired.

According to the invention, this object is achieved by an insole comprising:

(A) a support sole, the lateral delimitation (support sole delimitation) of which corresponds to the actual insole outline, that is to say the outer foot outline, at least in the front foot area, and as required in the midfoot and/or heel area;

(B) a dish-shaped edge (dish edge) extending upwardly,
  (1) which is provided at least in the front foot area, and as required in the midfoot and/or heel area,
  (2) which extends laterally beyond the support sole delimitation,
  (3) which is connected firmly to the support sole, and
  (4) which is manufactured from a material which is soft and flexible in relation to the support sole material;

(C) a thickening on the underside of the support sole,
  (1) which is provided at least in the area of the front foot bone, and as required in the midfoot and/or heel bone area,
  (2) the lateral delimitation (thickening delimitation) of which is displaced so far in the inward direction of the sole in relation to the support sole delimitation that a lasting margin recess is formed on the underside of the insole between the support sole delimitation and the thickening delimitation, and (D) one or more means for transverse stiffening and/or longitudinal flexibilization of the support sole and/or of the thickening, which means are provided at least in the front foot area.

This insole is preferably designed in such a manner that the means for transverse stiffening and/or longitudinal flexibilization of the support sole and/or of the thickening is a structural sole extending at least in the front foot area and made of hard, elastic material of transversely stable and longitudinally flexible structure.

In particular, said structural sole can have the following features:

(a) the structural sole extends at least over essentially the entire front foot area, preferably over essentially the entire foot sole area or the entire footprint area;

(b) the structural sole is formed in one piece from hard, elastic plate material of uniform thickness;

(c) the structural sole is profiled transversely to the longitudinal direction of the sole;

(d) the transverse profiling extends at least over essentially the entire front foot area, preferably over essentially the entire foot sole area or essentially over the entire footprint area;

(e) the resilient plate material has a groove-shaped, flute-shaped, rib-shaped, channel-shaped, wave-shaped, bead-shaped, meander-shaped, meander-like, zig-zag or trapezoidal transverse profiling, and (f) the transverse profiling is repeated periodically.

The structural sole is especially preferably manufactured from spring steel or from one or more plane or planar materials which are flexible in the longitudinal direction and/or transversely stiffened over the width.

Moreover, within the scope of the present invention, other means are also available alternatively or additionally for transverse stiffening and/or longitudinal flexibilization of the support sole and/or of the thickening, which can be provided at least in the front foot area, and if appropriate in the entire foot area, the means indicated below being listed by way of characterizing preferred embodiments of the invention but by no means exhaustively:

(a) the means for longitudinal flexibilization of the thickening can thus be indentations in the material of the thickening, which run transversely to the longitudinal direction of the insole and give the thickening, for example, a ladder-like structure.

(b) The means for transverse stiffening and/or longitudinal flexibilization of the support sole and/or of the thickening can furthermore be fibers or other longitudinally flexible and/or transversely stiff materials, such as, for example, special graphite or boron fibers, and/or material formations or shapes, such as transverse ribs.

(c) The means for transverse stiffening and/or longitudinal flexibilization of the support sole and/or of the thickening can also be materials of different Shore hardness, which are arranged next to one another running transversely to the longitudinal direction of the sole.

As far as the directional arrangement of the means for transverse stiffening and/or longitudinal flexibilization is concerned, these can be arranged in such a manner in the front foot area and if appropriate in the midfoot area that the maximum transverse stiffening runs at an angle $\alpha$ in the range from 77° to 90° to the longitudinal direction of the sole and/or the maximum longitudinal flexibility runs at an angle $\beta$ from 0° to −13° to the longitudinal direction of the sole, this area of transverse stiffening and/or longitudinal flexibility preferably extending over 30% to 60% of the longitudinal direction of the sole (preferably starting from the toe of the sole).

As far as the rear foot or heel area is concerned, the means for transverse stiffening and/or longitudinal flexibilization can be provided in such a manner in this area that the maximum transverse stiffening runs at an angle $\gamma$ in the range from 90° to 103° to the longitudinal direction of the sole and/or the maximum longitudinal flexibility runs at an angle $\delta$ from 0° to 13° to the longitudinal direction of the sole, the area of transverse stiffening and/or longitudinal flexibility of this type preferably extending over 20% to 40% of the longitudinal direction of the sole, starting from the sole end.

The sum of the angles $\alpha+\beta$ and also $\beta+\delta$ is preferably 180° in each case.

It should be pointed out that said angles are measured such that one side of the angle is directed forward from the longitudinal axis of the sole and the other side, starting therefrom, is turned by said angle $\alpha$, $\beta$, $\gamma$, or $\delta$ in the clockwise direction (as can be seen below in connection with the drawing).

These angles $\alpha$, $\beta$, $\gamma$, or $\delta$ can vary according to shoe size and according to the corresponding age of the wearer. In the case of a small child, an angle $\alpha$ and $\beta$ of the order of 90° is thus appropriate, and for shoe sizes 30 to 32 an angle $\alpha$ of 86° and an angle $\gamma$ of 94° are to be preferred, whereas for shoe sizes 33 to 35 an angle $\alpha$ of 81° and an angle $\gamma$ of 99° are preferred, and finally for shoe sizes 36 and above an angle $\alpha$ of 77° and an angle $\gamma$ of 103° are especially preferred. The angles $\beta$ and $\gamma$ follow from said angles by virtue of the fact that the direction of the longitudinal flexibilization is perpendicular to the direction of the transverse stiffening.

The insole according to the invention is furthermore preferably designed in such a manner that the dish edge is provided with means, for example notches or wedge-shaped incisions, which prevent a resistance or bridge effect and/or a throwing up of the dish edge in the area of the intended bend, in particular of the ball, intended bend meaning the movement of the shoe wearer, which is brought about when the ball of the foot rolls.

The underside of the support sole in the area of the lasting margin recess is especially preferably plane-surfaced or smooth so that excellent bonding and adhesion of the shoe upper material in the area of the lasting margin and thus outstanding durability of the shoe, as far as the connection between shoe upper material and sole is concerned, is guaranteed.

In order to ensure good durability and wearproofness of the insole according to the invention in particular when no spring steel insert for longitudinal flexibilization and transverse stiffening is provided, it is preferred that the thickening and/or the support sole or the entire insole has or have a Shore A hardness in the range from 90 to 100, preferably in the range from 92 to 98.

The entire insole can be designed as a one-piece part or consist of individual components which are preferably integrated or firmly connected to form a one-piece unit.

By means of the invention, the use of the above insole is made available for manufacturing a shoe of the type in which the insole and the shoe upper material are interconnected to form a self-supporting shoe structure, the height of the thickening being especially preferably the same as the thickness of the shoe upper material.

As already mentioned in the introduction, a shoe which is manufactured using an insole according to the invention, in particular in the above way, can be used in conjunction with one or more socks, the shape of the underside of which is preferably designed complementarily to the dish shape of the insole, for adaptation of the shoe to the particular foot width of the wearer in such a manner that a virtually ideal inner fit of the shoe for the wearer is achieved.

The above and other advantages and features of the invention are described and explained in greater detail below by means of some especially preferred embodiments with reference to the figures of the drawing, in which FIG. 1 shows a view from below of a preferred embodiment of an insole according to the invention;

FIG. 2 shows a cross section through a preferred embodiment of an insole according to the invention, transversely to the longitudinal direction of the sole;

FIG. 4 shows a side view of an embodiment of a sock according to the invention, and FIG. 5 shows a view of the sock in FIG. 4 from above.

Figure 3:
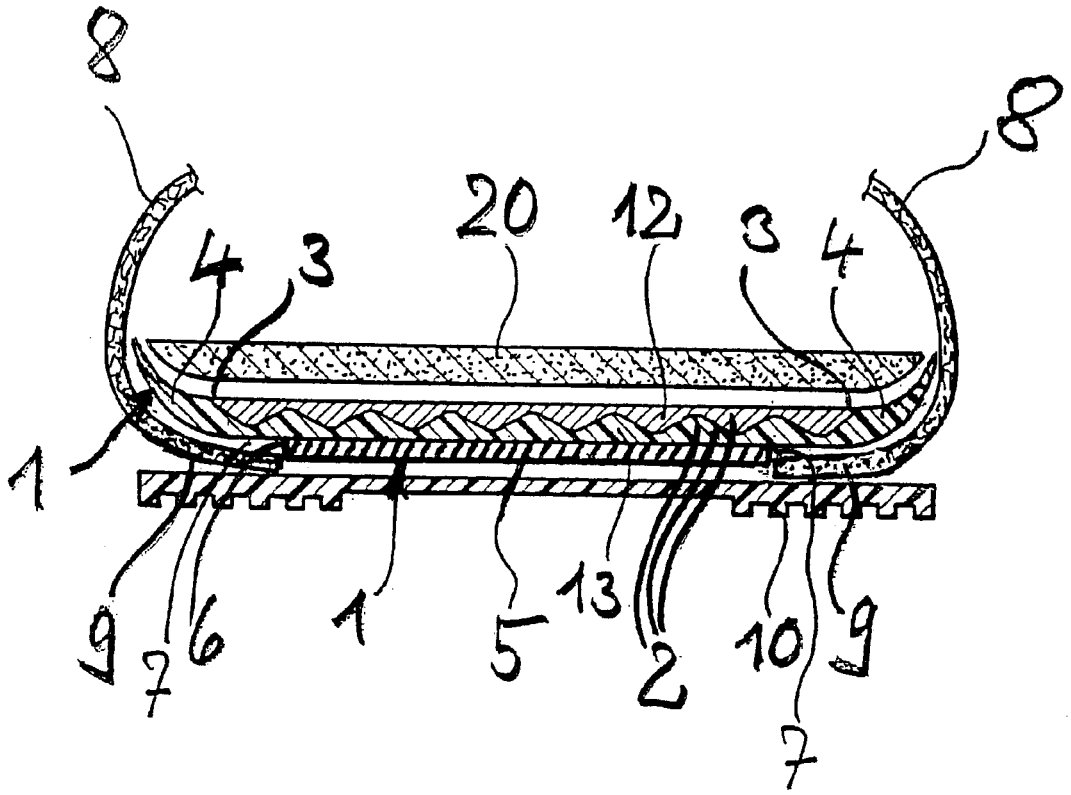
FIG. 3 shows a cross section through the lower front foot area of a shoe constructed with an insole according to the invention in an exploded illustration of the important individual parts.

In the description below, the insole according to the invention will also be described as a "dish edge insole" for the purpose of better characterization thereof.

The dish edge insole designated as a whole by reference number 1 in FIGS. 1, 2 and 3 of the drawing comprises the following individual elements:

(1) a support sole 2, the lateral delimitation 3 of which (support sole delimitation) corresponds to the actual insole outline (that is to say the outline actually occupied by an insole) at least in the front foot area, and if appropriate in the midfoot and/or rear foot area;

(2) a dish-shaped edge 4 (dish edge) extending upwardly, which has in particular the following features:

(a) the dish edge 4 is provided at least in the front foot area, but can also be provided in the midfoot and/or rear foot area, and can extend upwardly or could even be flat in these areas, (b) as FIGS. 1, 2 and 3 clearly show, the dish edge 4 extends laterally beyond the support sole delimitation 3, (c) the dish edge 4 is connected firmly to the support sole 2, and (d) the dish edge 4 consists of a material which is soft and flexible in relation to the relatively hard support sole material;

(3) the dish edge insole 1 also has a thickening 5 on the underside of the support sole 2, which has in particular the following features:

(a) the thickening 5 is provided at least in the area of the front foot bone, where it supports the tread surface of the foot, but can moreover be present in the midfoot and/or rear foot area, in particular in the foot bone area of the midfoot and/or of the rear of the foot, (b) the lateral delimitation 6 (thickening limitation) is displaced so far in the inward direction of the sole in relation to the support sole delimitation 3 that a lasting margin recess 7 is formed on the underside of the insole between the support sole delimitation 3 and the thickening delimitation 6, into which, as FIG. 3 shows, the shoe upper material 8 is inserted in the area of the lasting margin and where, as well as in the outer area of the dish edge 4, the material is firmly bonded to the dish edge insole, the thickening 5 normally having the same thickness as the shoe upper material 8 in the area of the lasting margin, so that the lasting margin 9 and the thickening 5 together form a virtually smooth underside, to which an outsole 10 (see FIG. 3) can be bonded all-over; and (4) means for transverse stiffening and/or longitudinal flexibilization of the support sole 2 and/or of the thickening 5 are moreover provided at least in the front foot area, and if appropriate also in the midfoot and/or rear foot area.

In FIGS. 2 and 3, the means for transverse stiffening and/or longitudinal flexibilization of the support sole and/or of the thickening are a structural sole 11 which consists of, for example, transversely profiled spring steel and extends in the area of the support sole 2, this structural sole 11 being embedded by flexible materials 12 and 13, so that the support sole 2 has a smooth upper and lower surface which can merge all-over with the thickening 5 at the bottom and seamlessly with the dish edge 4 at the side.

As far as the other preferred features of the structural sole are concerned, reference is made in relation to this to the embodiments above in the general part of the description.

A further important means, by which the thickening 5 can be made longitudinally flexible and transversely stable, can be seen in FIG. 1, according to which indentations 14 are provided in the thickening transversely to the longitudinal direction of the insole, which can extend through the entire thickness of the thickening 5 or through only a part of this thickness and give the thickening a ladder-like structure, as FIG. 1 shows especially clearly.

The angles $\alpha$ and $\gamma$ already explained in greater detail above, at which the transverse stiffening means, for example the ladder-like projections 15 between the indentations 14 of the thickening 5 and/or the crests 16 and valleys 17 of the undulating structural sole 11, preferably run, and which are equivalent to the direction of maximum transverse stiffening, and also the angles $\beta$ and $\delta$ of maximum longitudinal flexibility, which normally run perpendicularly to the maximum transverse stiffening, are drawn in for clarity in FIG. 1, the longitudinal axis of the sole being designated by reference number 18.

Also visible in FIG. 1 are notches or wedge-shaped incisions 19 which are provided in the dish edge 4 in the area of the intended bend, in particular of the ball, in order to prevent a bridge or resistance effect (resistance to the intended bend) and/or a throwing up (bending out or fold formation) of the dish edge 4.

Finally, in FIGS. 3, 4 and 5, a sock 20 is shown, which adapts the shoe to the foot width of the wearer and can be inserted positively into the upper side of the dish edge insole 1, so that it is retained in an anti-slip manner by the dish shape and in an anti-deformation manner by the stability of the dish edge insole according to the invention and guarantees highly stable adaptation to the foot width.

Other details and advantages of the dish edge insole according to the invention in its basic embodiment and in its different configurations are moreover described and explained as follows:

The insole is a dish edge insole which supports the foot, forms the basis of a multi-width system, and has a thickening 5 in the area of the filling mass, and indeed preferably with ladder-like transverse ribs, which ensures lateral stability.

The dish edge insole comprises a bottom 2, 5 and a lateral dish edge 4. The lateral dish edge 4 has a height h of preferably 3.5–8 mm at the front in the front foot area and 0 to 15 mm at the rear at the heel for receiving different socks 20, by means of which different foot widths and foot thicknesses (multi-width system) are accommodated. The thickness of the thickening 5 is preferably between 1.0 and 3.0 mm, and the thickness s of the support sole 2 is preferably 1.0 to 5.0 mm.

The advantage of the dish edge insole resides in particular in the fact that different foot widths and foot thicknesses with the same foot length can be received by one shoe; the different volumes of the feet are accommodated by different socks 20.

The thickening 5 is preferably manufactured from a compressed, condensed material. In order to ensure lateral stability and wearproofness, but not to impede flexibility, the thickening 5 of the thickened dish insole is preferably provided in a ladder-like manner with the transverse indentations 14 between the ladders 15. The direction of the transverse indentations is oriented according to the line of the loading processes and is preferably 77° to the longitudinal axis in the front foot area and 103° in the rear foot area in adults.

These angles of the ladder-like transverse grooves can vary according to shoe size and according to the corresponding age of the child. The sum of the transverse grooves is preferably always 180°. In a small child, a transverse groove of 90° in the front foot area and of 90° in the rear foot area is thus appropriate, for sizes 30 to 32 an angle of 86° in the front foot area and 94° in the rear foot area, for size 33 to 35 an angle of 81° in the front foot area and 99° in the rear foot area, and for shoe sizes above 36 the adult form 77° and 103°.

The advantage of these different angles resides in the fact that the sole adapts to the particular state of development of the foot so as to support the development of the child's foot from the square foot to the (slender) adult foot.

The thickening 5 of the bottom portion of the dish edge insole supports all main loading zones of the foot in all phases of the loading process. In this connection, the thickening 5 of the bottom 2, 5 of the dish edge insole 1 does not reach as far as the edge of the insole outline, but is located at such a distance inwardly from the latter that sufficient space 7 and material is present for a lasting margin and for bonding the upper 8.

In order to avoid a resistance effect, notches 14 can also be made on the upper side in the dish edge 4 of the dish edge insole, which increase the flexibility of the dish edge insole 1.

The dish-shaped insole 1 has supporting characteristics and is thus defined differently to normal insoles. It is the determining element of the shoe. The dish edge insole 1 supports and guides, and the sock 20 located thereon damps and guarantees a pleasant foot climate, in particular by means of a water absorption capacity.

The dish edge insole preferably has a high Shore hardness, preferably from 80 to 100. In order to ensure the flexibility of the dish edge insole, on the one hand the bottom is—as stated above—indented in a ladder-like manner or made longitudinally flexible in another way, and the dish edge is preferably notched in the area of the intended bending curve (ball) so as not to allow any bridge or resistance effect or throwing up of the dish edge.

The bonding surface of the thickening of the dish edge insole (corresponding to the filling mass) should be as plane-surfaced/smooth as possible.

The dish edge insole consists of a one-piece or multi-piece material which has a dish edge shape, the dish edge of which adapts to the outer foot shape. The dish bottom can receive a sock of different thickness to compensate for different widths and has a dish substrate which is set back so far from the dish sole outline that it supports the main loading zones during foot movement, consequently supports the foot and affords sufficient area at the side in order to last on or bond an upper, and guides the foot. Damping in the rear foot area and bedding in the front foot area are guaranteed by the sock.

The outline of the thickening of the filling mass is identical to the minimum requirements for transverse stiffening.

The dish edge insole is the ideal insole for a shoe.

A preferred embodiment of a sock for adaptation of a shoe, in particular one such as in FIG. 3, to different foot widths is shown in greater detail in FIGS. 4 and 5, that area located above the broken line in FIG. 4 and that area located outside the broken line in FIG. 5 being a dish edge R of the sock 20, while the other part is the inner area M of the sock 20, on which the foot of the wearer "stands" in the strict sense.

A shoe, for example the shoe shown in FIG. 3, is manufactured using a last to such a predetermined size that it can be adapted to different foot widths by means of a set of socks 20 according to the invention, in particular to a narrow, medium and wide foot width of the wearer of the shoe.

Such a set of socks 20 is characterized in that the socks 20 each have a different thickness $d_V$ in the front foot area V, while their thickness $d_F$ at the heel F is the same.

Such a sock set consists of, for example, three socks, the thickness $d_F$ at the heel of which has the same value of, for example, 8.5 mm in all three socks 20, while the thickness $d_V$ in the front foot area in each of these three socks has a different value, for example 5 mm in the case of the sock for a narrow foot width, 3.5 mm in the case of the sock for a medium foot width, and 2 mm in the case of the sock for a wide foot width.

Other for example values for a set consisting of three socks are: $d_F$=6 mm and $d_V$=3 mm or 4.5 mm or 6 mm, or $d_F$=5 mm and $d_V$=2 mm or 3.5 mm or 5 mm for adaptation to a narrow, medium and wide foot width respectively.

Orthopedic research within the scope of the invention has shown that it is appropriate to make the thickness $d_V$ in the front foot area within a sock set increase in each case by a fixed amount of change in thickness from sock to sock, which is 1.5 mm in the three examples above.

Furthermore, the thickness $d_F$ in the heel area is preferably the same as or greater than the thickness $d_V$ of that sock in the set which has the greatest thickness $d_V$ in the front foot area.

Fundamentally, the sock system according to the invention is suitable for shoes of all possible types of construction, in other words in particular for shoes which are not manufactured using the insole according to the invention or in accordance with the construction in FIG. 3. However, adaptation to the foot width in shoes which have an insole according to the invention or are manufactured in accordance with FIG. 3 is extremely stable, because the insole is very surface-stable, whereas the footbed surface of conventional shoes is in contrast deformed rapidly and uncontrolledly during wear, so that adaptation to the foot width in such conventional shoes becomes worse and worse over time, whereas it remains stable and optimum over virtually the entire life of the shoe in shoes according to the invention. In order to avoid such worsening of the adaptation in conventional shoes, the sock can be made transversely stable, and preferably longitudinally flexible, and can be reinforced in a dimensionally stabilizing manner by means such as in particular the means indicated above for the thickening and/or the support sole.

What is claimed is:

1. A shoe having a heel area and a front foot area comprising an upper having a thickness;

an insole having a support sole made of a material and having a lateral delimitation;

a dish shaped edge extending up from and laterally beyond said support sole lateral delimitation;

wherein said dish shaped edge is soft and flexible in relation to said support sole material;

a thickening located below said support sole and defining a lasting margin recess between a thickening lateral delimitation and said support sole delimitation and wherein said thickening having thickness having a thickness the same as said upper thickness; and a sock from a set of matched socks, each sock in the set having a heel thickness and a front foot thickness, wherein the heel thickness of each sock in the set is the same and the front foot thickness of the socks in the set is graduated from sock to sock to correspond, in cooperation with the insole, to a selection of different foot widths.

2. The shoe of claim 1 wherein said set of matched socks includes at least three different socks with graduated front foot thicknesses corresponding to a narrow, medium and wide foot width.

3. The shoe of claim 1, further including means for transverse stiffening of said thickening.

4. The shoe of claim 1, further including means for longitudinal flexibilization of said thickening.

5. The shoe of claim 1, further including means for transverse stiffening of said support sole.

6. The shoe of claim 1, further including means for longitudinal flexibilization of said support sole.

7. The shoe of claim 1, further including a notch formed in said dish shaped edge.

8. The shoe of claim 1, further including a wedge shaped incision in said dish shaped edge.

9. The shoe of claim 1 wherein said support sole has a transverse profiling.

10. The shoe of claim 9 wherein said transverse profiling is repeated periodically.

11. The shoe of claim 9 wherein said transverse profiling has a groove-shape, a flute shape, a rib shape, a channel shape, a wave shape, bead shape, meander shape, a meander like hape, a zig-zag shape or a trapezoidal shape.

12. The shoe of claim 1 wherein said thickening has a Shore A hardness in the range of 80 to 100.

13. The shoe of claim 1 wherein said support sole has a Shore A hardness in the range of 80 to 100.

14. A width adjustment system in a shoe having an insole with a support sole and a dish shape edge, including:

a sock from a set of matched socks, each sock in the set having a heel thickness and a front foot thickness with the heel thickness of each sock in the set being the same and the front foot thickness of the socks in the set being graduated from sock to sock to correspond, in cooperation with the insole, to a selection of different foot widths.

15. A method of making a shoe suitable for accommodating feet of different widths, including the steps of:

providing a shoe with an insole having a support sole and a dish shaped edge to accommodate a sock;

providing a set of matched socks, each sock in the set having an identical heel thickness and a front foot thickess that is graduated from sock to sock to correspond, in cooperation with the insole, to selection of different foot widths;

selecting a sock from the set of socks having a front foot thickness corresponding to the foot width of a wearer; and inserting the selected sock into the insole of the shoe.

* * * * *